US006695058B1

(12) United States Patent
French

(10) Patent No.: US 6,695,058 B1
(45) Date of Patent: Feb. 24, 2004

(54) METHOD AND APPARATUS FOR CLEANING BOREHOLES

(75) Inventor: Clive French, Jambes (BE)

(73) Assignee: Quartech Engineering Limited, Tonbridge (GB)

( * ) Notice: Subject to any disclaimer, the term of this patent is extended or adjusted under 35 U.S.C. 154(b) by 0 days.

(21) Appl. No.: 09/958,012

(22) PCT Filed: Mar. 30, 2000

(86) PCT No.: PCT/GB00/01117

§ 371 (c)(1),
(2), (4) Date: Jan. 7, 2002

(87) PCT Pub. No.: WO00/58602

PCT Pub. Date: Oct. 5, 2000

(30) Foreign Application Priority Data

Mar. 30, 1999 (GB) ..... 9908399
Oct. 20, 1999 (GB) ..... 9924674

(51) Int. Cl.[7] ..... E21B 37/02
(52) U.S. Cl. ..... 166/312; 166/173
(58) Field of Search ..... 166/311, 312, 166/170, 173, 176

(56) References Cited

U.S. PATENT DOCUMENTS

| | | | | | |
|---|---|---|---|---|---|
| 1,741,497 | A | * | 12/1929 | Boltz | |
| 4,515,212 | A | * | 5/1985 | Krugh | 166/99 |
| 5,280,825 | A | * | 1/1994 | Cholet | 166/311 |
| 2001/0040035 | A1 | * | 11/2001 | Appleton et al. | 166/387 |
| 2002/0104649 | A1 | * | 8/2002 | Allen | 166/173 |

FOREIGN PATENT DOCUMENTS

| | | | |
|---|---|---|---|
| FR | 2382259 | * | 3/1978 |
| GB | 2335687 | | 9/1999 |
| WO | WO00/12864 | * | 3/2000 |

* cited by examiner

*Primary Examiner*—William Neuder
(74) *Attorney, Agent, or Firm*—Gifford, Krass, Groh, Sprinkle, Anderson & Citkowski, P.C.

(57) ABSTRACT

A method of cleaning a casing-lined borehole comprises the steps of: circulating fluid in the borehole to entrain material in the circulating fluid; separating the entrained material from the fluid within the borehole; and then removing the separated material from the borehole.

26 Claims, 4 Drawing Sheets

METHOD AND APPARATUS FOR CLEANING BOREHOLES

FIELD OF THE INVENTION

The present invention relates to a method and apparatus for cleaning boreholes. In particular, but not exclusively, the present invention relates to a method and apparatus for removing particulate debris from a casing-lined borehole in an onshore or offshore oil or gas well.

BACKGROUND OF THE INVENTION

It is known to create an onshore or offshore oil or gas well by drilling a borehole extending from the surface (at ground or seabed-level respectively), before installing a cylindrical, typically metal casing in the borehole, and cementing the casing into the borehole. The borehole may be "deviated" (extending at an angle from the vertical) and may feature branch or lateral boreholes which may themselves be lined and cemented. Such operations often lead to the inside wall of the casing becoming soiled with materials such as drilling mud residue ("mud-cake"), well fluid residue, and cement residue, which may hamper subsequent downhole operations, and the satisfactory withdrawal of well fluids.

In order to overcome problems associated with the build-up of such materials, it is necessary to physically remove these materials from the casing wall. Typically this is accomplished by inserting a rotating string having a drill bit and\or a dedicated casing scraper tool into the casing, running the drill bit and\or scraper to the bottom of the casing, and then working the drill bit and\or scraper up and down the casing. The residue materials are then circulated out of the well by pumping a cleaning fluid through the casing, which transports the materials to the surface.

However, it becomes increasingly difficult to circulate the materials out of the casing in extended reach and deviated wells. Therefore a number of devices have been developed to facilitate entrainment and removal of the residue materials, incorporating brushes and other agitators. However, these devices have been found to be unreliable or ineffective in removing the residue materials.

It is amongst the objects of the present invention to obviate or mitigate at least one of the foregoing disadvantages.

BRIEF SUMMARY OF THE INVENTION

According to a first aspect of the present invention, there is provided a method of cleaning a casing-lined borehole, the method comprising the steps of:

circulating fluid in the borehole to entrain material therein;

separating the entrained material from the fluid within the borehole; and removing the separated material from the borehole.

According to a second aspect of the present invention, there is provided an apparatus for use in removing material from a borehole, the apparatus comprising:

circulating means for circulating fluid in a borehole to entrain material therein; and separating means for separating the entrained material from the fluid within the borehole.

References to a casing-lined borehole refer to a borehole which has been lined with a suitable casing, liner, or any other suitable tubular lining member, as will be appreciated by persons skilled in the art.

Thus the present invention may allow a fluid to be circulated in a casing-lined borehole to entrain material in the borehole, typically material gathered in the end of the borehole or in the "low" side of an inclined or horizontal bore, by entraining the material in a carrier fluid, separating the material from the fluid and subsequently removing the separated material to the surface.

The material may be mud residue, such as mud-cake, well debris, or cement residue or the like, produced by the operations involved in creating a lined borehole. Further, the material may be sand or scale, which may build up in the bore during production. The material may have been adhered to the inner wall of the borehole, and may be dislodged from the borehole inner wall in the course of the cleaning operation. Preferably, the material is dislodged using a drill bit and\or a casing scraper coupled to a support string which also supports the apparatus. The string, for example a string of drill pipe, may be rotated from the surface, and may be run into the borehole to the region of the borehole to be cleaned before being moved axially in the borehole to dislodge material from the wall thereof. Alternatively, the apparatus may be run on wireline or coiled tubing.

The fluid may be a viscous mud, a cleaning fluid such as brine, and may contain any appropriate additives. The fluid may be pumped down the borehole from the surface, through a string bore or through an annulus between a string and an inner wall of the borehole, or may be recirculated within the borehole.

Preferably, the circulating means includes an impeller, preferably a screw, which is rotatable to facilitate circulation of fluid in the borehole. The impeller may be coupled to a supporting string, such that rotation of the string imparts rotation on the impeller. Alternatively, the impeller may rotate while the supporting string remains stationary. In other embodiments, for example where the apparatus is mounted on wireline or coiled tubing, rotation may be provided by electric motor or hydraulic motor. The circulating means may further include a pump located on surface or in a supporting string.

Preferably, a tubular member or sleeve is provided, having an inlet for receiving fluid circulating in the borehole. The inlet may be normally closed, and may be opened by fluid pressure force, for example by fluid being pumped through a supporting string. One or more fluid jetting outlets may be provided above the inlet, to permit fluid to be jetted into the annulus above the inlet to create a barrier to carrier fluid flow. Radially extending flow deflectors, which may be in the form of blades, may also be provided above the inlet, to scrape or otherwise dislodge material from the inner wall of the borehole and into the fluid inlet. The flow deflectors may be normally retracted, and may be extended by fluid pressure. Preferably also, the impeller is located within the tubular member. The material may be separated from the fluid within the tubular member. The tubular member may include an outlet having a filter which retains the solid material, allowing the fluid to pass therethrough to return to the surface or to pass to a downhole pump for recirculation. The filter may be annular or cylindrical, or may be formed by forming the outlet of restricted area openings, such as slits. A plurality of such filters may be provided, for example the filters may define successively reducing flow passages. Preferably, the impeller is adapted to clean the filter, for example the impeller may be a screw and move across the face of the filter. This prevents build up of material on the filter, and minimises the possibility of the filter clogging.

The fluid may be pumped into the borehole through a string of pipes passing through the tubular member and having an outlet in the borehole. The fluid outlet may be at or towards the bottom of the string. The outlet may be provided in a drill bit. Alternatively, the fluid may be pumped into the borehole down an annulus formed between an outer wall of the tubular member and the wall of the borehole. In a yet further alternative, the tubular member may be provided on a wireline, slickline, or coil tubing assembly.

A venturi may be disposed within the tubular member to create a restriction to flow of fluid through the tubular member, to increase the fluid velocity and aid circulation of the fluid and entrainment of solid material therein.

One or both of the impeller and tubular member may be coupled to a support string. In one embodiment, a differential gear assembly is provided to couple the tubular member to the support string. Thus, when the string is rotated, which may also serve to dislodge material from the inner wall of the borehole, the tubular member may be counter-rotated. Alternatively, the tubular member may be fixed against rotation within the borehole such that relative rotation between the tubular member and the string may be provided when the string is rotated.

In a further alternative embodiment, the impeller may be coupled to the tubular member. The string may remain rotationally stationary, and the tubular member and screw may be rotated to provide relative rotation therebetween. Alternatively, the string may be rotated from the surface to counter-rotate the tubular member and screw via the differential gear assembly.

The material may be isolated within the borehole by providing a storage chamber within the tubular member. The storage chamber may be disposed in an annular or cylindrical cavity defined by inner walls of the member and at least partially defined by a filter. Thus, material separated from the fluid by the filter may be collected in the storage chamber, which material may be removed from the borehole by withdrawing the tubular member. Alternatively, the tubular member may have an upper inlet; fluid may be pumped into the borehole below the tubular member and circulated around the tubular member through an annulus defined between the outer wall of the tubular member and the wall of the borehole, thereby transporting entrained material up the annulus. This may create a venturi effect, such that fluid exiting the annulus above the tubular member decreases in velocity, causing the entrained material to come out of suspension with the fluid and fall into the tubular member.

Preferably also, the apparatus includes means for dislodging material from the borehole wall, which means may include a drill bit, casing scraper or end mill. Most preferably, the apparatus includes a body carrying a scraper defined on a flat of the body, the body including means for urging the scraper towards the borehole wall. Said urging means may be normally retracted, and may be extended by fluid pressure. The urging means may be in the form of one or more shoulders, circumferentially spaced from the scraper, and adapted to direct fluid towards the scrapers. The scraper may include one or more blades, with a fluid channel defined in front of each blade, such that fluid may pass upwardly through the channels. Preferably, at least two blades are provided, a leading blade defining a relatively aggressive cutting surface to dislodge and break up material, such as scale, from the borehole wall, and the following blade being less aggressive to clean the wall.

BRIEF DESCRIPTION OF TEE DRAWINGS

Embodiments of the invention will now be described, by way of example, with reference to the accompanying drawings, in which.

DETAILED DESCRIPTION OF THE INVENTION

Figure 1:
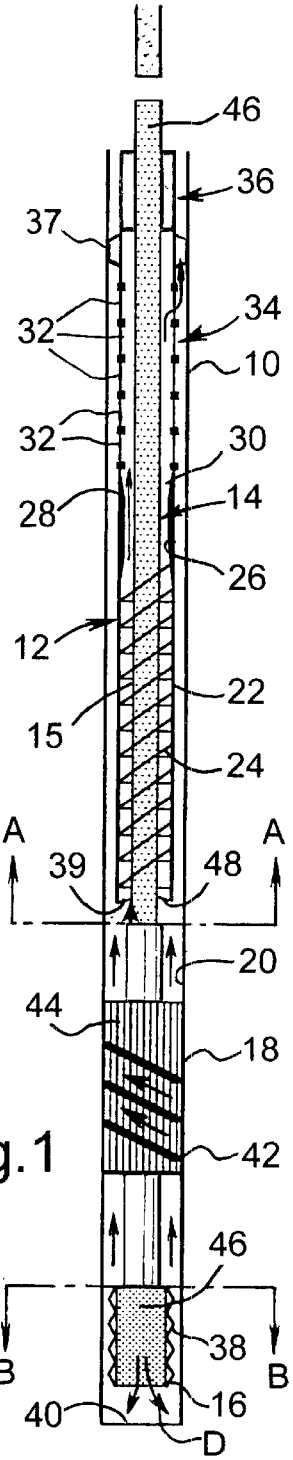
FIG. 1 is a view of apparatus for use in cleaning a casing-lined borehole in accordance with an embodiment of the present invention, shown in section above line A—A and below line B—B.

Referring firstly to FIG. 1, there is shown an apparatus for use in cleaning a borehole in which a casing has been installed and cemented, the apparatus indicated generally by reference numeral 12. The apparatus 12 is coupled to a tubular drill string 14, above a drill bit 16 and a casing scraper 18. Mud residue (known as "mud-cake"), well debris and\or cement residue (not shown) have become adhered to the inner wall 20 of the casing 10 during preliminary well operations, and require removal as such residues may hamper further operations and the extraction of well fluids from the borehole.

The apparatus 12 comprises an annular metal sleeve 22, a right-hand threaded screw impeller 24 located within the sleeve 22 and coupled to a pipe 15 which forms part of the string 14, an annular venturi restriction 28 extending radially from the inner wall 26 of the sleeve 22 into a sleeve cavity 30, a slotted screen filter 32 forming an upper portion 34 of the sleeve 22, and a gear assembly 36. The solid-walled lower end of the sleeve 22 is of slightly larger diameter than the slotted upper portion 34 of the sleeve 22, to minimise erosion of the screen by fluid flowing upwardly in the annulus between the sleeve 22 and the bore wall 20.

To facilitate manufacture and replacement, the screw impeller 24 is formed of 3 feet (approximately 1 meter) segments. Also, the screw impeller 24 tapers as it extends upwardly; this tapering profile, providing increasing clearance between the screw 24 and the inner wall of the sleeve 22, facilitates compaction of material above the screw 24 without stalling the screw.

As will be described, in use the apparatus collects debris from the bore in the upper slotted portion 34 of the sleeve and, while the apparatus 12 is in use, the debris is retained in the sleeve 22 by the action of the screw impeller 24. However, while the apparatus 12 is being tripped out, there may be no rotation of the impeller 24, such that the debris may tend to move downwardly within the sleeve 22. To prevent loss of such material, the open lower end of the sleeve 22 is provided with a diaphragm 39 which acts as a one-way valve, that is fluid and solids may flow upwardly into the sleeve 22, but are prevented from dropping back out of the sleeve.

To prevent the sleeve 22 from rotating in the bore when the apparatus 12 is in use, the sleeve 22 carries four circumferentially spaced blocks 37 which act as brakes and are activated to extend and contact the casing wall 20 when the pipe 15 rotates. The blocks 37 are configured to retract when the pipe 15 is placed in tension.

The drill bit 16 has cutting teeth 38 which, as the drill string 14 is rotated in a clockwise direction (viewing in the direction of the arrows B) from the surface, remove portions of the residue adhered to the inner wall 20 of the casing 10, the dislodged residue material falling to the bottom 40 of the borehole. Likewise, the casing scraper 18 includes left-hand threaded scraper blades 42 which extend helically around the outer surface 44 of the scraper 18, and which protrude from the surface 44. The scraper blades 42 remove residue material from the inner wall 20 of the casing 10 in a similar manner to the drill bit 16, with the dislodged material likewise falling to the bottom 40 of the borehole. This residue material is then removed, as will be described in more detail below.

The differential gear assembly 36 comprises three bevelled gears (not shown), a first of which is coupled to the drill string 14, a second of which is coupled to the sleeve 22 in face-to-face disposition with respect to the first gear, and the third of which is disposed perpendicular to the first and second gears and coupling them together. Thus, rotation of the drill string 14 and associated screw 24 from the surface imparts a counter-rotation on the sleeve 22, in the opposite direction to the drill string 14.

In the position shown in FIG. 1, the apparatus 12 has been run to the bottom 40 of the borehole, with the drill bit 16 and casing scraper 18 having dislodged the material adhered to the inner wall of the casing 10 as described above. To ensure complete removal of the residue material, the drill string 14 is raised and lowered along the length of the casing 10 before being returned to the bottom 40 as shown in FIG. 1. A viscous mud 46 is pumped down the inside of the drill string 14 from the surface, exiting the string 14 from the drill bit 16, as shown by the arrows "D" in FIG. 1. This fluid 46 entrains any residue material which has collected in the bottom 40 of the borehole, and the fluid then flows up the casing 10 to the scraper 18. The scraper blades 42 are, as described above, raised from the outer surface 44 of the scraper 18, creating a helical flow path for the fluid 46, allowing the fluid to flow around the scraper 18 in the direction of the arrows shown. The fluid then continues up the casing 10, entering the sleeve 22 via an annular sleeve inlet 48. Suitable packing means (not shown) may be provided to seal the sleeve 22 in the casing 10, or at least restrict flow between the sleeve and casing, whilst permitting the rotation of the sleeve 22.

The right-hand threaded screw 24 draws the fluid 46 carrying the residue material through the sleeve 22, as the screw 24 rotates in the same direction as the drill string 14. The screw 24 is of outside diameter slightly smaller than the inside diameter of the sleeve 22, to provide a close fit with the sleeve 22, to prevent residue material from travelling down between the screw 24 and the inner wall 26 of the sleeve 22. The venturi 28 increases the velocity of the fluid 46 exiting the portion of the sleeve 22 above the screw 24, to faciliate circulation of the fluid 46, and to assist in the removal of residue material from the screw 24. The fluid 46 carrying the residue material then passes into the upper portion 34 of the sleeve 22, and the fluid exits the apparatus 12 through the annular filters 32, as shown by the arrows in FIG. 1. The solid residue material separated from the fluid by the filters 32 is collected in the annular cavity 30 extending from the venturi 28 to the gear assembly 36. When all of the residue material has been collected in the cavity 30, or the cavity 30 has been filled, the apparatus 12 is retrieved to the surface, where the sleeve 22 is de-coupled from the drill string 14 for cleaning and removal of the residue material.

Figure 2:
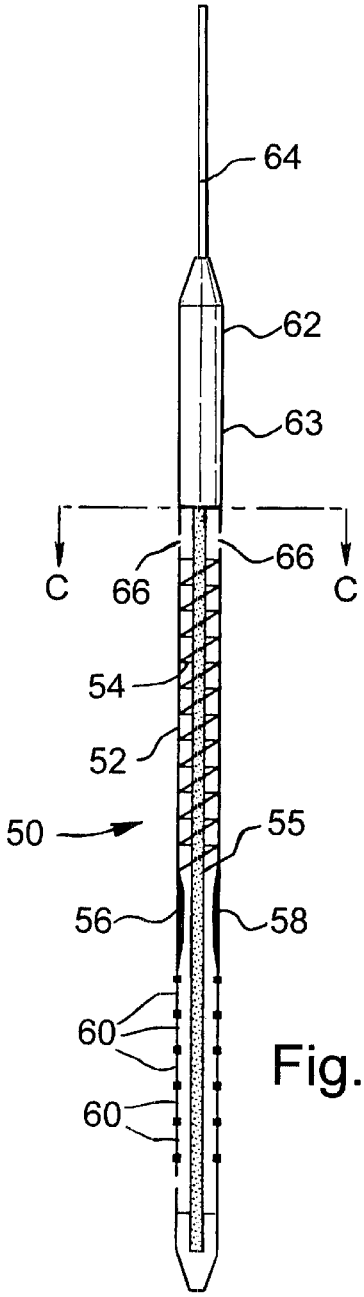
FIG. 2 is a view of apparatus for use in cleaning a casing lined borehole in accordance with an alternative embodiment of the present invention, shown in section below line C—C.

Referring now to FIG. 2, there is shown a bore cleaning apparatus indicated generally by reference numeral 50. The apparatus 50 is mounted on an "electric" wireline of a type known in the art, enabling the apparatus 50 to be rapidly deployed or removed from the borehole. The apparatus 50 comprises a tubular metal sleeve 52 containing a bearing-mounted right-hand threaded screw 54 coupled to a tool string 55, a venturi restriction 58 within the sleeve 52, annular filters 60 in a lower portion of the sleeve 52, and an electric motor 62 disposed within the sleeve 52. The motor 62 is coupled to a power supply on the surface via the wireline 64, and is coupled via a gear assembly 63 to the tool string 55. The upper end of the sleeve 52 defines a number of apertures 66, to allow fluid communication between the borehole and the sleeve interior. The tool string 55 is rotated by the electric motor 62 and rotation of the tool string 55 and the screw 54 draws fluid carrying entrained residue material from the borehole, through the apertures 66, and into the sleeve 52. The residue material and fluid travel down through the sleeve 52, the fluid passing out of the sleeve through the filters 60, where the residue material is separated from the fluid. The apparatus 50 is drawn up through the borehole simultaneously, to facilitate the flow of fluid and residue material through the sleeve 52.

Various modifications may be made to the foregoing embodiments within the scope of the present invention.

For example, the fluid circulated through the borehole may be a cleaning fluid, or a viscous mud including a cleaning fluid or a cleaning additive. The fluid may be pumped down the annulus formed between a drill string and a sleeve and the inner wall of the casing, returning to the surface via the drill string. The sleeve may be fixedly sealed within the borehole via a suitable packer or the like. The screw may be coupled to the sleeve. The drill string may remain rotationally stationary, and the sleeve and screw may rotate around the string, driven by a suitable downhole motor.

A sleeve may be provided defining an upper inlet and with a closed lower end. Thus fluid pumped down a drill string and into the borehole below the sleeve may flow up through an annulus between the outer wall of the sleeve and the inner wall of the borehole, creating a venturi effect. The sleeve may define a chamber for collecting the solid material, which may fall out of suspension with the fluid when the fluid exits the annulus, adjacent the sleeve inlet location.

Reference is now made to FIGS. 3 to 8 of the drawings, which illustrate apparatus 70 in accordance with a further embodiment of the present invention. As will be described below, the apparatus 70 is utilised to dislodge debris from the wall of a bore, entrain the dislodged material in a stream of fluid, separate the material from the fluid, and retain the separated material within the apparatus 70.

Figure 3:
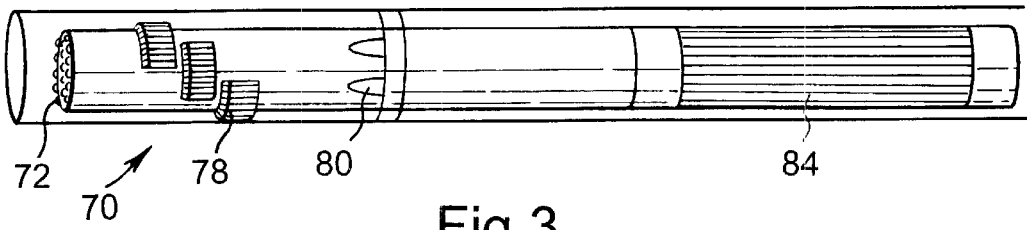
FIG. 3 is a perspective view of apparatus in accordance with a further embodiment of the present invention.

Reference is first made to FIG. 3. The apparatus 70 is intended to be mounted on the end of a work string (not shown) or the like capable of transmitting drilling fluid and rotation from the surface, and thus the upper end of the apparatus 70 defines a conventional coupling for engagement with the end of the supporting string. The lower end face of the apparatus 70 defines a milling face 72, and the side face of the apparatus 70 above the mill defines cutters 74, 76 (FIG. 4) for scraping and cleaning the bore wall. In addition, the side face of the apparatus 70 adjacent the cutters 74, 76 carries cutter positioning elements in the form of radially extendible shoulders 78. As will be described, the shoulders 78 may be energised to locate the cutters 74, 76 adjacent the bore wall. Upwardly of the cutters 74, 76 and shoulders 78 are fluid inlets 80, through which fluid is drawn by a screw impellor arrangement 82 (see FIG. 8). As will be described, and in a somewhat similar manner to the above-described embodiments, the screw 82 draws fluid and debris into an annular chamber having an external slotted screen wall 84. Thus, solids entrained in the fluid are retained within the screen 84, while the fluid is free to flow through the slotted screen 84 and up through the annulus to the surface.

Figure 4:
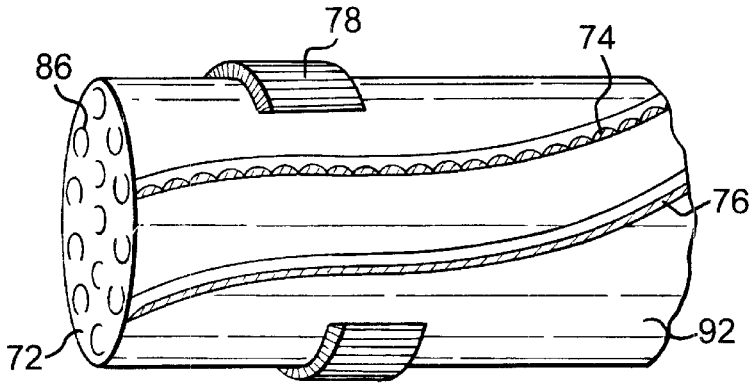
FIG. 4 is an enlarged view of milling and cutting portions of the apparatus of FIG. 3.
Figure 5:
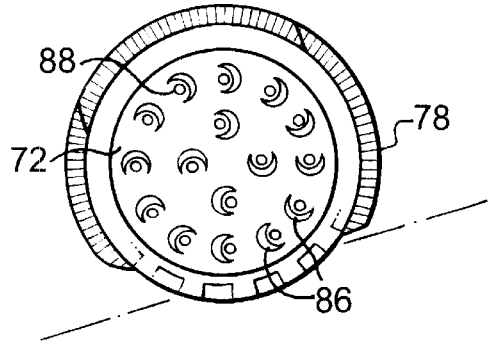
FIG. 5 is an end view of the apparatus of FIG. 3, showing the milling portion.

Reference is now also made in particular to FIGS. 4 and 5 of the drawings, which show the milling face 72 defined by the lower end of the apparatus 70 and which carries aggressive cutting elements 86. The face 72 also defines jetting nozzles 88 through which drilling fluid may pass from the hollow interior of the apparatus 70 to impinge on the surface being milled.

Figure 6:
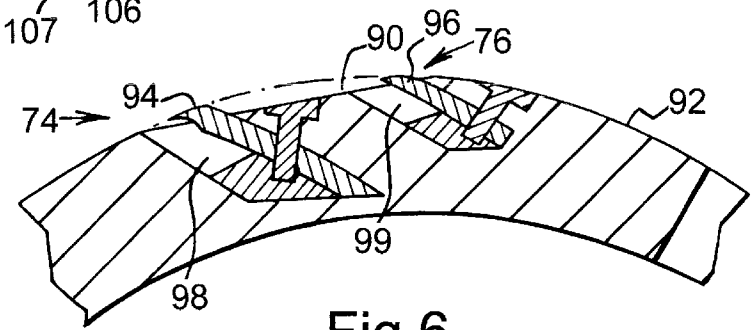
FIG. 6 is an enlarged sectional view of the cutter portion of the apparatus of FIG. 3.

The cutters 74, 76 extend along the side wall of the lower end of the apparatus 70, and details of the cutters are also shown in FIG. 6 of the drawings. As may be seen from this figure, the cutters are located on a "flat" 90 on the otherwise cylindrical sub 92 which forms the lower end of the apparatus. The first cutter 74 features an angled fixed blade 94 providing an aggressive cutting surface to break up mud cake, cement residue, scale and the like on the inner surface of the well bore casing, the second cutter 76 featuring a less aggressive fixed blade 96 which is intended to clean the casing wall. Both cutters 74, 76 define respective drilling fluid valleys 98, 99 along which the drilling fluid may flow, carrying debris produced by the action of the milling face 72, and also carrying debris dislodged from the casing wall by the blades 94, 96.

Figure 7:
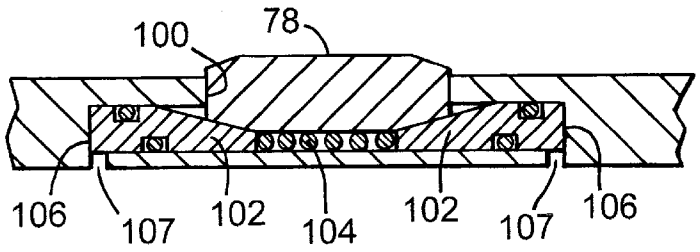
FIG. 7 is an enlarged sectional view of a cutter is positioning element of the apparatus of FIG. 3.

The three shoulders 78 are axially spaced along the sub 92 and are staggered around the sub circumference, and thus serve to direct drilling fluid towards the cutters 74, 76. Further, when energised to extend radially from the sub 92, the shoulders 78 tend to push the sub flat 90 towards the casing wall, and thus push the cutter blades 94, 96 into contact with the casing wall. A section of one of the shoulders 78 is shown in FIG. 7 of the drawings, and it will be seen that the shoulder 78 is mounted in an aperture 100 in the sub wall, and sits on a pair of mirror-image cammed pistons 102 which are normally pushed apart by a spring 104, such that the shoulder 78 may assume a retracted position. The pistons 102 each have a face 106 in communication with the hollow interior of the sub 92 via passages 107 such that elevated drilling mud pressure within the apparatus 70 will tend to push the pistons 102 towards one another, and urge the shoulder 78 radially outwardly.

Figure 8:
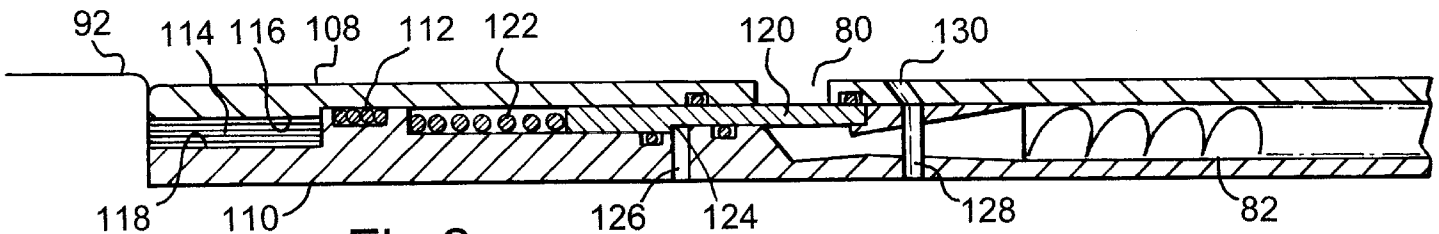
FIG. 8 is an enlarged sectional view of a solids separation portion of the apparatus of FIG. 3.

Reference is now made in particular to FIG. 8 of the drawings, this showing an enlarged sectional view of the solid separation portion of the apparatus 70. This portion is located upwardly of the milling and cutting portion and includes the fluid inlets 80 which are defined in an outer sleeve 108 of slightly smaller diameter than the sub 92. The sleeve 108 is mounted on an inner mandrel 110 and is rotatable relative thereto with bearings 112 being provided between the sleeve 108 and the mandrel 110 as appropriate. Furthermore, a drive cog 114 is provided between racks 116, 118 defined by the sleeve and mandrel 108 and 110, which results in the sleeve 108 rotating in the opposite direction to the mandrel 110. The resulting contra rotation of the screw 82, which is mounted on the mandrel 110, draws fluid in through the inlets 80 and carries the fluid to the separating portion.

The fluid inlets 80 are normally closed by a sleeve 120 mounted on the mandrel 110 and which is urged to close the inlets 80 by a spring 122. The sleeve 120 however defines a piston face 124, in communication with the mandrel throughbore via a passage 126, such that elevated drilling fluid pressure within the mandrel bore causes the sleeve 120 to retract and open the inlets 80. Further passageways 128 are provided above the inlets 80, the passageways 128 leading to jets 130 which, in use, create a fluid barrier in the annulus around the sleeve 108, such that fluid and debris flowing up the annulus are directed into the inlets 80.

In use, the apparatus 70 is run in to the well bore with minimum rotation and drilling mud circulation. On reaching the bottom of the bore or the desired work area, the flowrate and pressure of drilling mud pumped into the string is increased, energising the shoulders 78, and pushing the cutters 74, 76 into contact with the casing wall. The string is also rotated. The drilling fluid exits through the jetting nozzles 88 in the milling face 72 and then passes upwardly through the valleys 98, 99 defined by the cutters 74, 76, carrying away the debris displaced by the blades 94, 96. Above the cutters 74, 76, the increasing pressure of drilling fluid will have caused the drilling sleeve 120 to retract and open the fluid inlets 80, and the flow of drilling fluid through the jets 130 above the inlets 80 creates a barrier such that the fluid flowing up the annulus is directed through the inlets 80. The fluid, and any debris entrained therein, is then drawn upwardly through the sleeve 108 by the screw 82, in a similar manner to the first embodiment, the fluid then passing through the slots in the screen wall 84, leaving the debris trapped within the sleeve 108 above the screw 82.

When the "clean up" operation is completed, the rate of circulation of drilling fluid is reduced, such that the sleeve 120 closes the inlets 80, trapping any retained debris between the sleeve 108, screen 84, and the mandrel 110. The apparatus 70 may then be withdrawn from the well bore.

Figure 9:
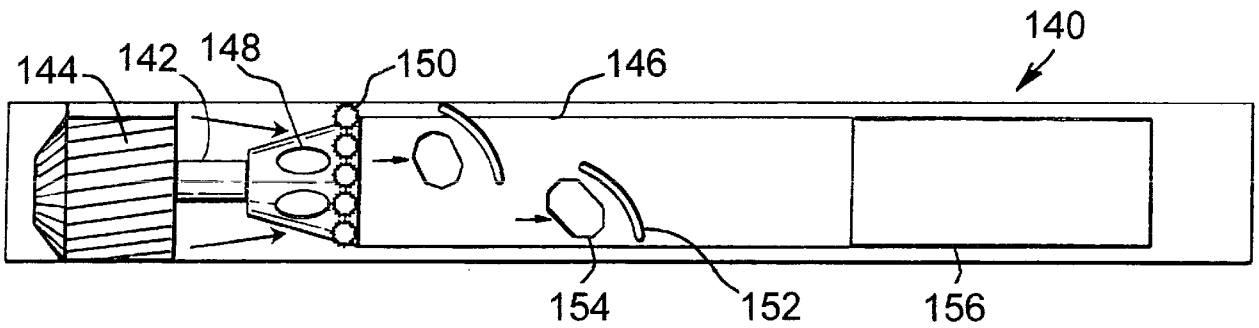
FIG. 9 is a diagrammatic view of apparatus in accordance with a still further embodiment of the present invention.

Reference is now made to FIG. 9 of the drawings, which illustrates an apparatus 140 in accordance with a still further embodiment of the present invention. The apparatus 140 has a substantially similar screw and screen arrangement to the embodiments described above, and these features will therefore not be described again in any detail. However, the lower portion of the apparatus 140 differs somewhat from those embodiments described above.

The apparatus 140 features a mandrel 142 which is rotatable with a supporting workstring (not shown) and provides mounting for a drill bit 144. Rotatably mounted on the mandrel 142, rearwardly of the bit 144, is a sleeve 146 which, in use, does not rotate relative to the well bore wall. The sleeve 146 has a tapered leading end which defines a number of fluid inlets 148 which open into an annulus between the sleeve 146 and the mandrel 142. As with the above-described embodiment, passageways extend through the mandrel 142 and the sleeve 146 such that, in use, jets of drilling fluid 150 exit the sleeve 146 above the inlets 148, creating a fluid barrier.

Figure 11:
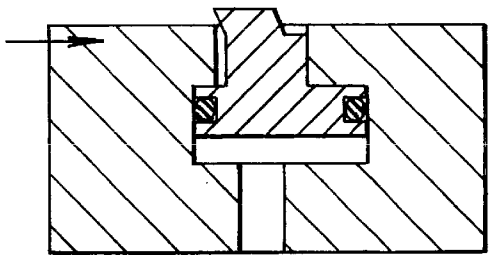
FIGS. 10 and 11 are diagrammatic sectional views of a scraper blade of the apparatus of FIG. 9, shown in extended and retracted configurations respectively.
Figure 10:
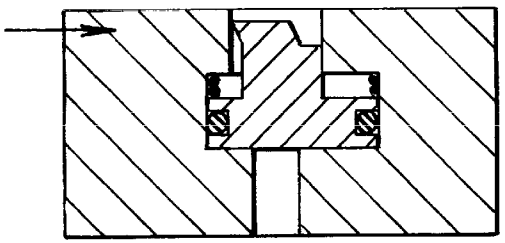

The sleeve 146 further carries three blades 152 which, in a similar manner to the shoulders 78 described above, are energisable by internal fluid pressure to extend outwardly from the sleeve 146 into contact with the casing wall. One of the blades 152 is illustrated diagrammatically in FIGS. 10 and 11 of the drawings, shown in retracted and extended configuration respectively. Directly in front of each blade is an aperture 154 opening into the annulus between the mandrel 142 and the sleeve 146. The passage of fluid through this annulus, from the fluid inlets 148, creates vortices which draw debris and fluid dislodged from the casing wall by the blades 152 in through the apertures 154.

In use, the apparatus 140 is run into a bore to be cleaned mounted on an appropriate workstring. The string is rotated and thus rotates the mandrel 142 and the drill bit 144. Drilling fluid is pumped through the string and exits the jetting nozzles in the drill bit 144. This fluid then passes upwardly around the drill bit 144 and into the fluid inlets 148, with the jets 150 creating a fluid barrier as described above. The elevated drilling fluid pressure within the apparatus 140 will have energised the blades 152, which stabilise and rotationally lock the sleeve 146 in the bore and prevent the sleeve 146 from rotating with the mandrel 142. Reciprocal movement of the apparatus causes the blades 152 to knock debris from the casing wall, and this debris is drawn into the blade apertures 154 by the fluid flowing upwardly between the S mandrel 142 and the sleeve 146. The drilling fluid, and entrained debris, then passes through a screw chamber 156 and a separator (not shown) in a similar manner to the above-described embodiments. The screw chamber 156 is coupled to the sleeve 146, and thus does not rotate, while the screw within the chamber 156 rotates with the work string and mandrel 142.

What is claimed is:

1. A method of cleaning a casing-lined borehole, the method comprising the steps of:

running a tool into the borehole carrying a rotatable cutting member and rotating the cutting member to dislodge material from the wall of the borehole;

rotating an impeller in the tool to circulate fluid in the borehole, to entrain the dislodged material in the fluid and to circulate the fluid through the tool;

separating the entrained material from the fluid within the borehole; and removing the separated material from the borehole.

2. The method of claim 1, wherein the fluid is pumped down the borehole from the surface and then returned to the surface.

3. The method of claim 1, wherein the fluid is recirculated within the borehole.

4. Apparatus for use in removing material from a borehole, the apparatus comprising:

a rotatable cutting member which is rotated to dislodge material adhered to the wall of the borehole;

a rotatable impeller for circulating fluid in the borehole, to entrain the dislodged material in the fluid and to circulate the fluid through the apparatus; and separating means for separating the entrained material from the fluid within the borehole.

5. The apparatus of claim 4, wherein the dislodging means includes a drill bit.

6. The apparatus of claim 4, wherein the dislodging means includes a casing scraper.

7. The apparatus of claim 4, wherein the impeller is coupled to a drive means for imparting rotation to the impeller.

8. The apparatus of claim 4, further comprising a tubular member including a fluid inlet.

9. The apparatus of claim 8, wherein the inlet is normally closed, and is openable by fluid pressure force.

10. The apparatus of claim 8, further comprising at least one fluid jetting outlet provided above the inlet, to permit fluid to be jetted into an annulus above the inlet to create a barrier to fluid flow.

11. The apparatus of claim 8, further comprising a radially extending flow deflector provided above the fluid inlet, to scrape material from the inner wall of the borehole and direct the scraped material into the fluid inlet.

12. The apparatus of claim 11, wherein the flow deflector is normally retracted, and is extendable by application of fluid pressure.

13. The apparatus of claim 8, wherein the tubular member includes an outlet having a filter which retains solid material, while allowing fluid to pass therethrough.

14. The apparatus of claim 8, further comprising a venturi disposed within the tubular member to create a restriction to flow of fluid through the tubular member, to increase the fluid velocity and aid circulation of the fluid and entrainment of solid material therein.

15. The apparatus of claim 4, wherein the impeller is located within the tubular member.

16. The apparatus of claim 4, wherein the impeller is in the form of a screw.

17. The apparatus of claim 16, wherein the screw extends over a surface of a filter disposed at an outlet from the tubular member to remove material from the filter surface.

18. The apparatus of claim 15, wherein at least one of the impeller and the tubular member is coupled to a support string for rotation therewith.

19. The apparatus of claim 18, in which at least one of the impeller and tubular member is coupled to the support string such that rotation of the support string causes counter rotation of the at least one impeller and tubular member.

20. The apparatus of claim 15, wherein at least one of the impeller and tubular member is coupled to a downhole motor for rotation thereby.

21. The apparatus of claim 4, wherein the apparatus further comprises a storage chamber for separated material.

22. The apparatus of claim 4, Wherein the apparatus further comprises a body carrying a scraper disposed on a flat of the body, the body further including means for urging the scraper towards the borehole wall.

23. The apparatus of claim 22, wherein said urging means is normally retracted, and is extendable by fluid pressure.

24. The apparatus of claim 22, wherein said urging means comprises at least one shoulder, circumferentially spaced from the scraper, and adapted to direct fluid towards the scraper.

25. The apparatus of claim 22, herein the scraper comprises at least one blade, including a fluid channel disposed therebelow, such that fluid may pass upwardly through each channel.

26. The apparatus of claim 22, wherein the scraper comprises at least two scraper blades, including a leading blade defining a relatively aggressive cutting surface to dislodge and break up material from the borehole wall, and a following blade defining a less aggressive cutting surface to clean the wall.

* * * * *

UNITED STATES PATENT AND TRADEMARK OFFICE

CERTIFICATE OF CORRECTION

PATENT NO. : 6,695,058 B1
DATED : February 24, 2004
INVENTOR(S) : Clive French

It is certified that error appears in the above-identified patent and that said Letters Patent is hereby corrected as shown below:

Column 9,
Line 25, after “the” (first occurrence), delete “S”.

Column 10,
Line 25, replace “4” with -- 8 --.
Line 55, replace “herein” with -- wherein --.

Signed and Sealed this

Fifteenth Day of March, 2005

JON W. DUDAS
*Director of the United States Patent and Trademark Office*